US009198822B1

(12) United States Patent
Hao

(10) Patent No.: US 9,198,822 B1
(45) Date of Patent: Dec. 1, 2015

(54) MULTI-FUNCTION CRUTCH

(71) Applicant: Dyaco(Shanghai)Trading Co.,Ltd., Shanghai (CN)

(72) Inventor: Kuo-Wo Hao, Taipei (TW)

(73) Assignee: Dyaco (Shanghai) Trading Co., Ltd., Shanghai (CN)

( * ) Notice: Subject to any disclaimer, the term of this patent is extended or adjusted under 35 U.S.C. 154(b) by 0 days.

(21) Appl. No.: 14/565,151

(22) Filed: Dec. 9, 2014

(30) Foreign Application Priority Data

Aug. 25, 2014 (TW) ..... 103129135 A

(51) Int. Cl.
*A61H 3/02* (2006.01)

(52) U.S. Cl.
CPC ..... *A61H 3/02* (2013.01); *A61H 2003/0233* (2013.01); *A61H 2003/0238* (2013.01)

(58) Field of Classification Search
CPC ... A61H 3/02; A61H 3/00; A61H 2201/1635; A61H 2003/006; A61H 2003/0211; A61H 2003/0233; A61H 2003/0238; A45B 9/02
USPC ..... 135/65–66, 67, 69, 71–73, 75, 84
See application file for complete search history.

(56) References Cited

U.S. PATENT DOCUMENTS

| | | | | | |
|---|---|---|---|---|---|
| 2,388,778 | A | * | 11/1945 | Wheeler | 135/68 |
| 2,408,604 | A | * | 10/1946 | Brickson | 135/69 |
| 2,409,365 | A | * | 10/1946 | Lamb | 135/71 |
| 2,811,978 | A | * | 11/1957 | Russell | 135/65 |
| 4,151,853 | A | * | 5/1979 | Inbar | 135/71 |
| 4,248,256 | A | * | 2/1981 | Thomas | 135/67 |
| 5,390,687 | A | * | 2/1995 | Tsai | 135/65 |
| 2003/0098052 | A1 | * | 5/2003 | Fismer | 135/76 |

FOREIGN PATENT DOCUMENTS

| | | | | |
|---|---|---|---|---|
| JP | 2007014613 | A | * | 1/2007 |
| JP | 2008086610 | A | * | 4/2008 |
| TW | M338069 | U | | 8/2008 |
| TW | M410588 | U | | 9/2011 |

* cited by examiner

*Primary Examiner* — Winnie Yip
(74) *Attorney, Agent, or Firm* — Donald E. Stout; Stout, Uxa & Buyan, LLP

(57) ABSTRACT

A multi-function crutch comprises a crutch structure, a supporting structure, and one or more additional crutch structures. The crutch structure itself can be used as a crutch. Via the supporting structure, the crutch structure combines one of the one or more additional crutch structures so that it can be used as another type of crutch.

9 Claims, 11 Drawing Sheets

MULTI-FUNCTION CRUTCH

CROSS-REFERENCE TO RELATED APPLICATIONS

The entire contents of Taiwan Patent Application No. 103129135, filed on Aug. 25, 2014, from which this application claims priority, are expressly incorporated herein by reference.

BACKGROUND OF THE INVENTION

1. Field of the Invention

The present invention relates to a crutch, and more particularly relates to a multi-function crutch.

2. Description of Related Art

A crutch is a mobility aid that transfers user's weight from the legs to the upper body. It is often used for people who cannot use their legs to support their weight, for reasons ranging from short-term injuries to lifelong disabilities.

There are several types of crutches, for example, underarm crutch, forearm crutch, platform crutch, and the likes. Typically conventional crutches have only one function. If more functions are needed, one or more other different types of crutch will be needed to buy. This will spend much money and need a large space to store.

SUMMARY OF THE INVENTION

In one general aspect, the present invention relates to a multi-function crutch.

In an embodiment of the present invention, a multi-function crutch is provided with a crutch structure, a supporting structure, and one or more additional crutch structures. The crutch structure itself is capable of being used as a first type of crutch. Via the supporting structure, the crutch structure combines one of the one or more additional crutch structures so that the combination is used as a second type of crutch.

In an embodiment, the one or more additional crutch structure comprise an underarm structure.

In an embodiment, the one or more additional crutch structure comprise a forearm structure.

In an embodiment, the crutch structure comprises a handle, a stick, and a support.

In an embodiment, the supporting structure comprises a through portion and a recess portion, and the combination is done by: the stick being passed through the through portion, and an assembling end of the additional crutch structure being inserted into the recess portion.

In an embodiment, the multi-function crutch further comprises a fastening mechanism for fixing the crutch structure and the additional structure.

In an embodiment, the fastening mechanism comprises a bolt and a hollowed body through which the additional crutch structure passes, and wherein the hollowed body has a side with a coupling portion coupling with the handle and another opposite side with a hole matching the bolt.

In an embodiment, the support comprises a plurality of legs.

In an embodiment, the crutch structure has a length-adjusting mechanism.

In an embodiment, each of the one or more additional crutch structures has a length-adjusting mechanism.

DETAILED DESCRIPTION OF THE PREFERRED EMBODIMENT

Figure 1:
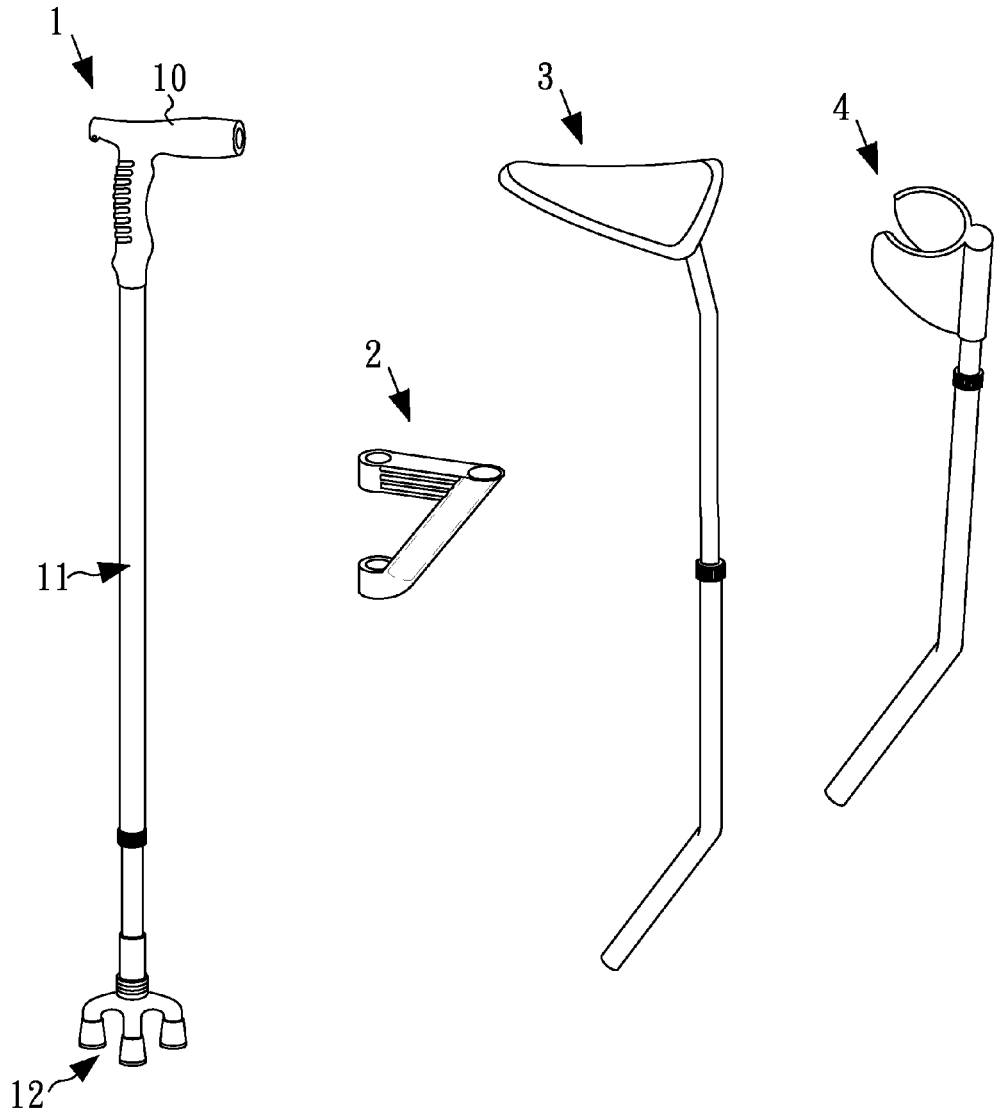
FIG. 1 is a front view showing an unassembled multi-function crutch according to a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are mechanism forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1 shows unassembled components of a multi-function crutch in accordance with a preferred embodiment of the present invention. As shown in FIG. 1, the multi-function crutch may comprise a crutch structure 1, a supporting structure 2, and one or more additional crutch structures, e.g., an underarm structure 3 and a forearm structure 4.

The crutch structure 1 itself can be used as a crutch. As shown in FIG. 1, the crutch structure 1 may comprise, but is not limited to, a handle 10, a stick 11, and a support 12. The handle 10 is used to be held by the user. The stick 11 has two ends, in which one end couples with the handle 10, and the other end couples with the support 12. The support 12 is against the ground, providing sufficient friction, buffer, and stability.

Figure 2:
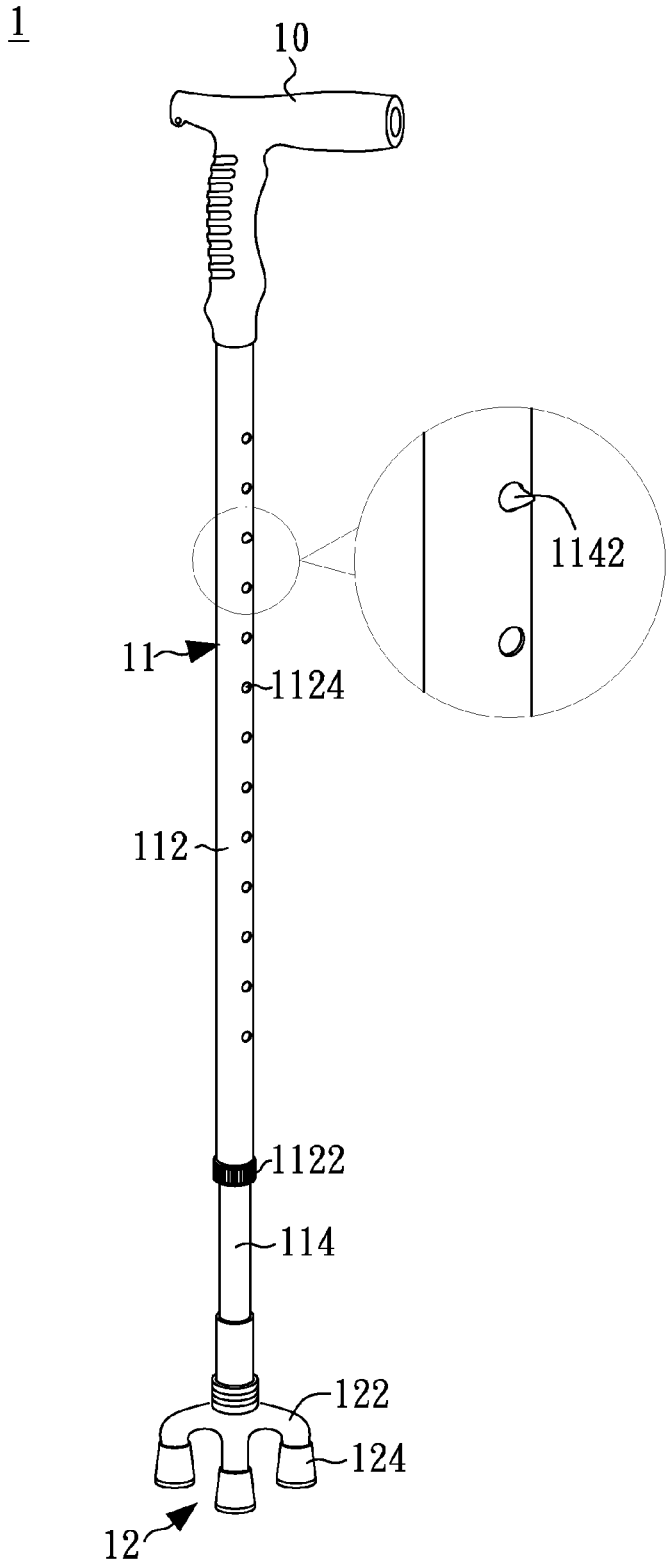
FIG. 2 is a front view showing a crutch structure of the multi-function crutch according to the preferred embodiment of the present invention.

FIG. 2 shows the details of the crutch structure 1. In this embodiment, the support 12 comprises a plurality of legs 122 and a rotatable ball (not shown) arranged between the stick 11 and the legs 122, so that the support 12 can be freely rotated and hence the flexibility and the stability of the crutch are increased. In addition, each leg 122 may have a detachable sheath 124, and a cone-shaped structure (not shown) is exposed when the sheath 124 is detached. The cone-shaped structure is suitable for using on the wet, muddy, or snowy ground or floor. Further, the stick 11 may comprise a length-adjusting mechanism. For example, the stick 11 may comprise a tube 112 and an inner stick 114 that can slide within the tube 112. In addition, the tube 112 may have a securing mechanism 1122 and a plurality of positioning holes 1124, and the inner stick 114 may have a resilient protrusion 1142. The securing mechanism 1122 is used to lock or unlock the inner stick 114. When the securing mechanism 1122 (e.g., an expansion bolt) releases the inner stick 114, the user can press the protrusion 1142, so that the inner stick 114 can slide within the tube 112 until the protrusion 1142 is positioned at one of the positioning holes 1124. After that, the securing mechanism 1122 is used to lock the inner stick 114, and the length of the stick 11 is adjusted.

Figure 3:
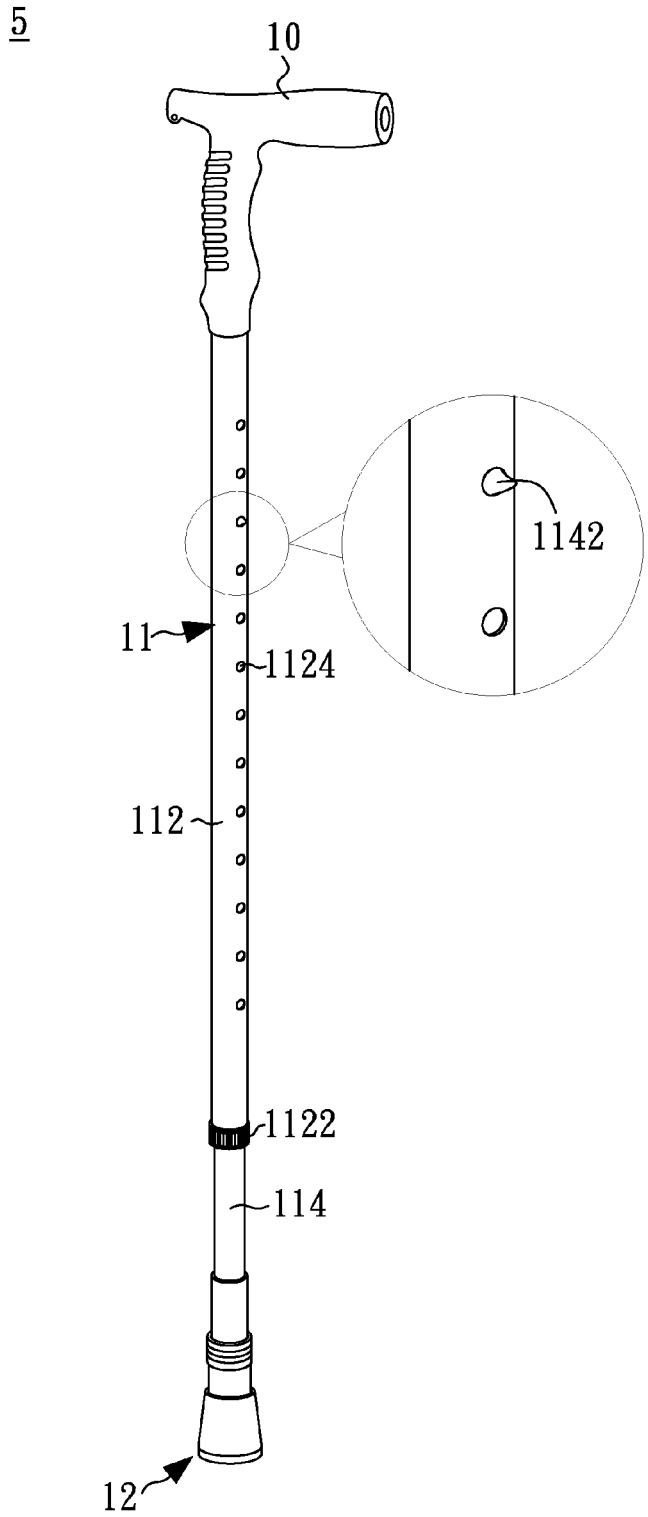
FIG. 3 is a front view showing a crutch structure of the multi-function crutch according to another embodiment of the present invention.

According to the present invention, the support 12 could have other configurations known in the art. For example, FIG. 3 shows a crutch structure 5 of a multi-function crutch according to another embodiment of the present invention. In this embodiment, the support of the crutch structure 5 has only one leg instead of plurality of legs.

According to embodiments of the present invention, the crutch structure 1 or the crutch structure 5 can combine with one additional crutch structure via the supporting structure 2, and the combined structure is used as another type of crutch. For example, the combination of the crutch structure 1 and the forearm structure 4 is used as a forearm crutch, and the combination of the crutch structure 1 and the underarm structure 3 is used as an underarm crutch.

Figure 4A:
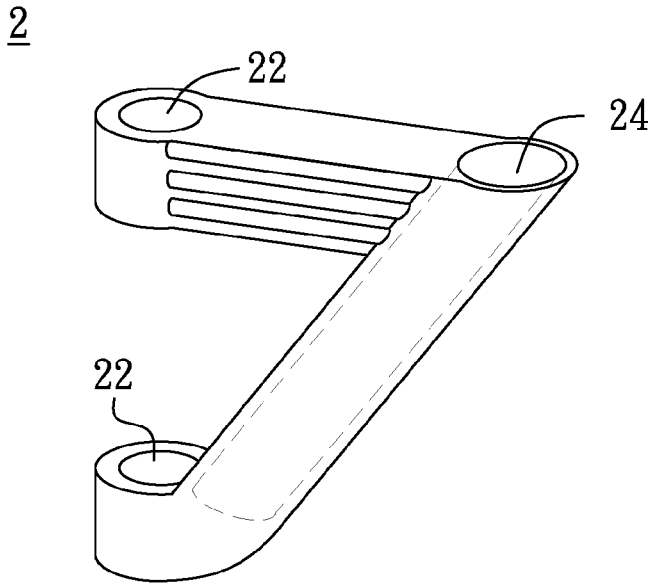
FIGS. 4A and 4B are perspective view and cross-sectional view, respectively, showing a supporting structure of the multi-function crutch according to the preferred embodiment of the present invention.
Figure 4B:
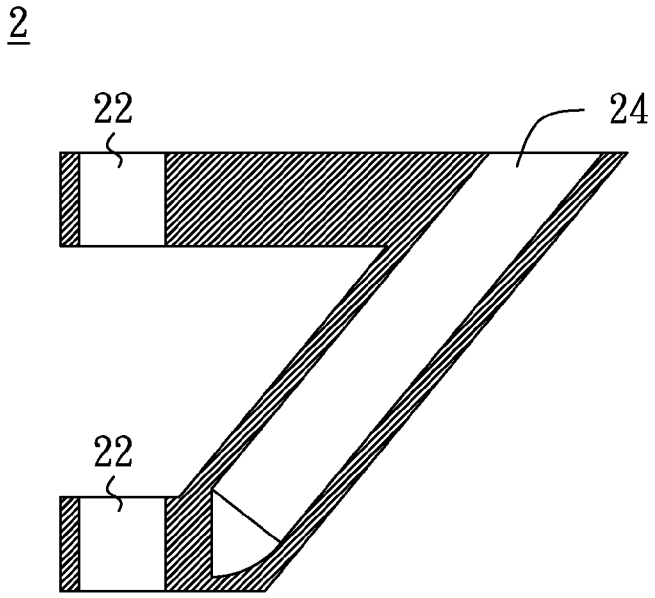

FIGS. 4A and 4B are front view and cross-sectional view, showing the supporting structure 2 in accordance with the preferred embodiment of the present invention. In this embodiment, the supporting structure 2 has a triangular or trapezium-shaped or ladder-shaped configuration, and it could be other configurations in other embodiments of the present inventions. As shown in FIGS. 4A and 4B, the supporting structure 2 may have a through portion 22 and a recess portion 24. The stick 11 of the crutch structure 1 (or crutch structure 5) can pass through the through portion 11, and one end the additional crutch structure, such as the underarm structure 3 (FIG. 1) or the forearm structure 4 (FIG. 1), can be placed in the recess portion 24.

Figure 5A:
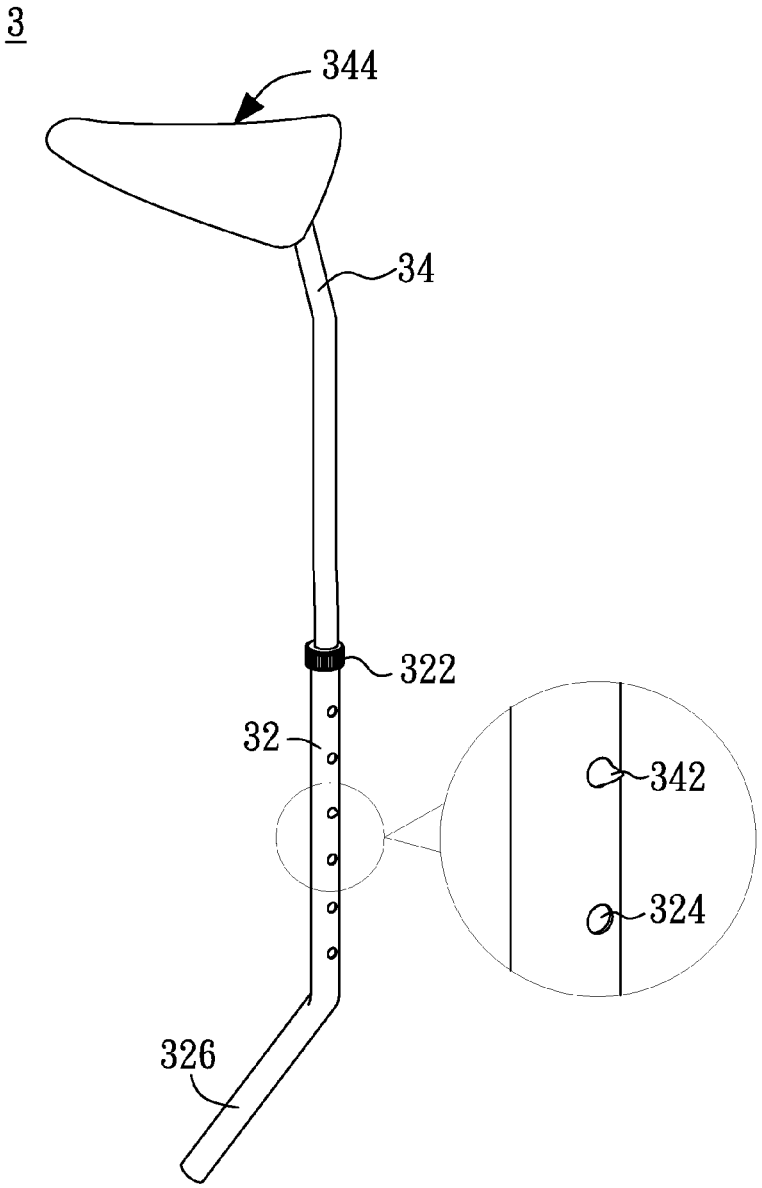
FIGS. 5A-5D are front view and partially enlarged views showing an underarm structure of the multi-function crutch according to the preferred embodiment of the present invention.
Figure 5B:
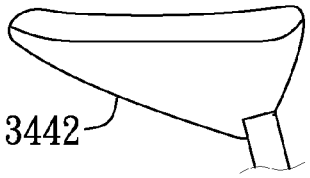
Figure 5C:
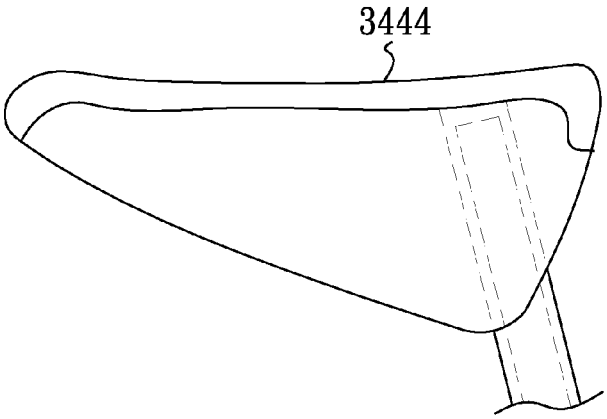
Figure 5D:
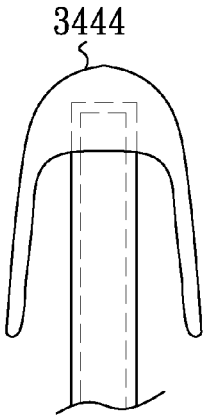

FIG. 5A shows the underarm structure 3 of the multi-function crutch in accordance with the preferred embodiment of the present invention. Preferably, the underarm structure 3 comprises a tube 32 and an inner stick 34 that can slide within the tube 32. In addition, the tube 32 may have a securing mechanism 322 and a plurality of positioning holes 324, and the inner stick 34 may have a resilient protrusion 342. The securing mechanism 322 is used to lock or unlock the inner stick 34. When the securing mechanism 322 (e.g., an expansion bolt) releases the inner stick 34 (e.g., by rotation), the user can press the protrusion 342, so that the inner stick 34 can slide within the tube 32 until the protrusion 342 is selectively positioned at one of the positioning holes 324. After that, the securing mechanism 322 is used to lock the inner stick 34, and the length of the underarm structure 3 is adjusted. In addition, the tube 32 has an assembling end 326 to assemble with supporting structure 2. The inner stick 34 has an underarm support 344 for supporting the user's underarm. The underarm support 344 may comprise an underarm frame 3442 (as shown in FIG. 5B) and an underarm pad 3444 (as shown in FIGS. 5C and 5D).

Figure 6A:
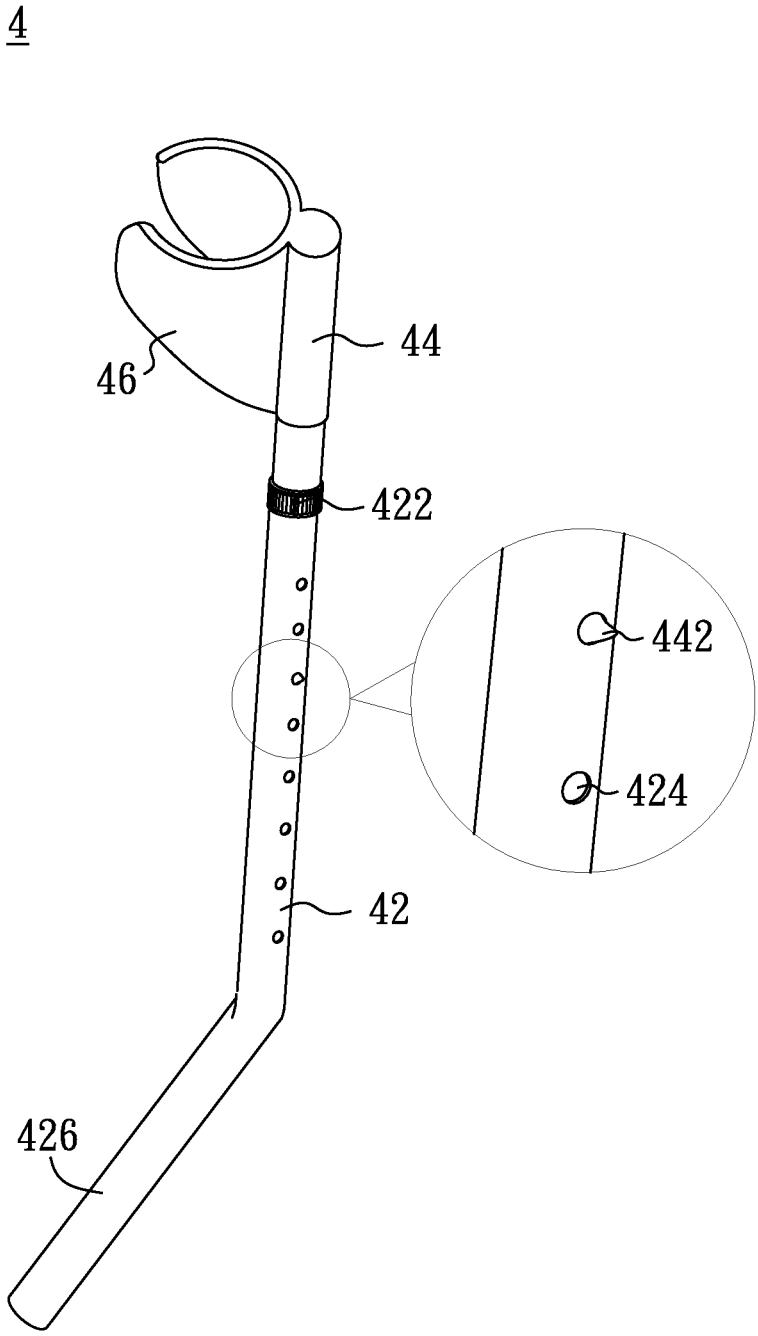
FIGS. 6A-6C are front view and partially enlarged views showing an forearm structure of the multi-function crutch according to the preferred embodiment of the present invention.
Figure 6B:
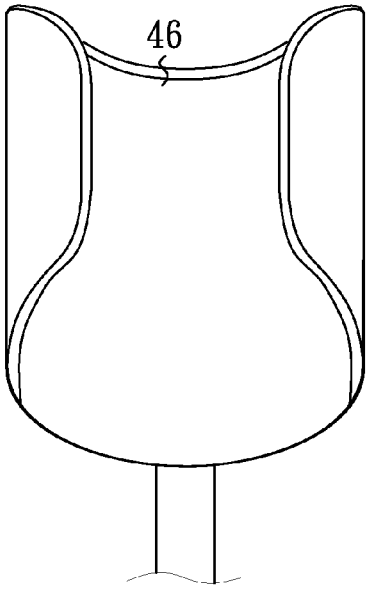
Figure 6C:
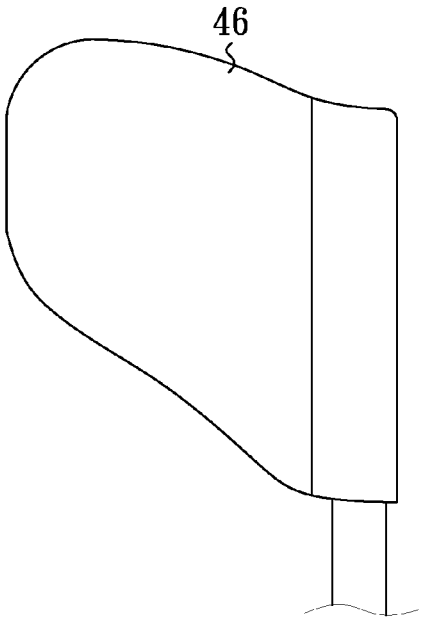

FIG. 6A shows the forearm structure 4 of the multi-function crutch in accordance with the preferred embodiment of the present invention. Preferably, the forearm structure 4 comprises a tube 42 and an inner stick 44 that can slide within the tube 42. In addition, the tube 42 may have a securing mechanism 422 and a plurality of positioning holes 424, and the inner stick 44 may have a resilient protrusion 442. The securing mechanism 422 is used to lock or unlock the inner stick 44. When the securing mechanism 422 (e.g., an expansion bolt) releases the inner stick 44 (e.g., by rotation), the user can press the protrusion 442, so that the inner stick 44 can slide within the tube 42 until the protrusion 442 is selectively positioned at one of the positioning holes 424. After that, the securing mechanism 422 is used to lock the inner stick 44, and the length of the forearm structure 4 is adjusted. In addition, the tube 42 has an assembling end 426 to assemble with supporting structure 2. The inner stick 44 has a cuff support 46 for supporting the user's forearm or elbow. FIGS. 6B and 6C are top view and side view of the cuff support 46.

Figure 7:
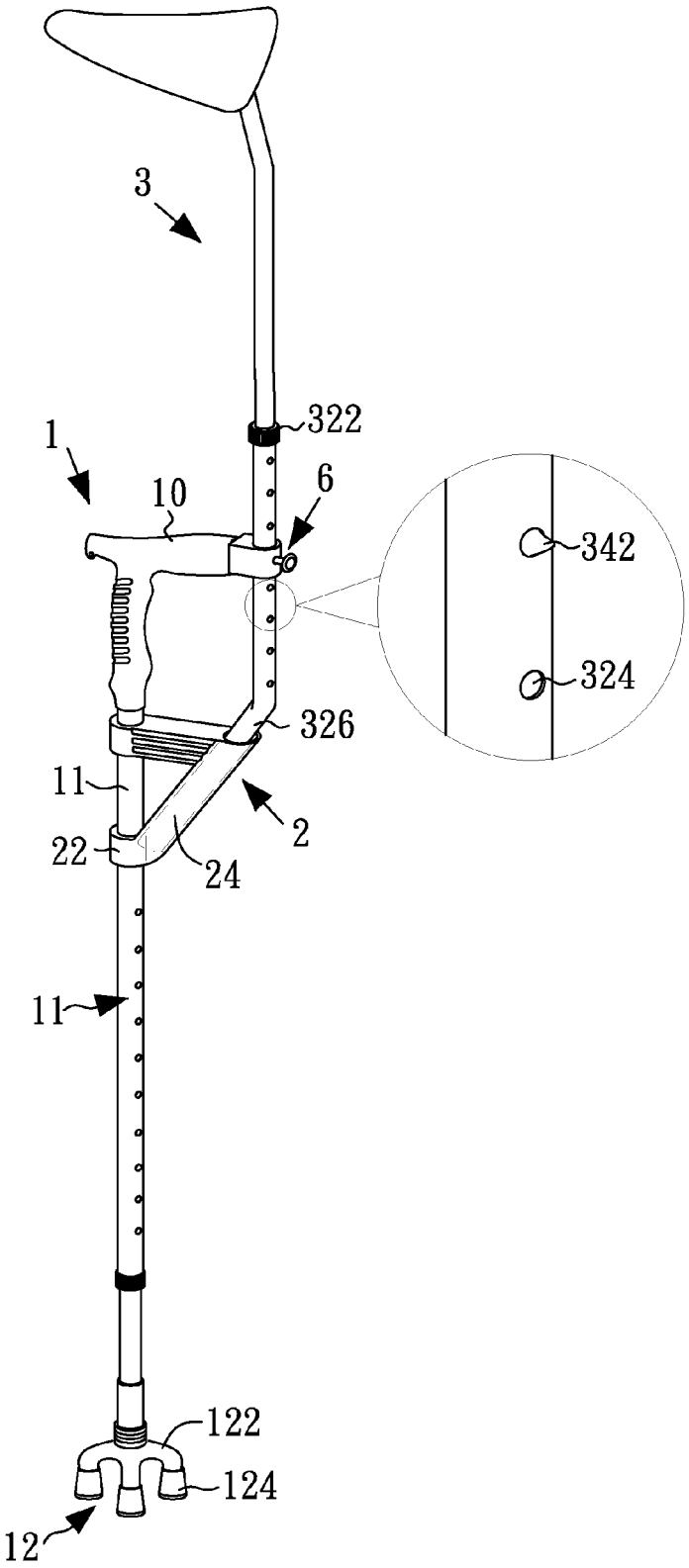
FIG. 7 is a front view showing that the crutch structure and the underarm structure is combined as an underarm crutch according to the preferred embodiment of the present invention.

FIG. 7 shows that the combination of the crutch structure 1 and the underarm structure 3 via the supporting structure 2 can be used as an underarm crutch. In detail, the combination is done by: (1) the stick 11 of the crutch structure 1 passes through the through portion 22 of the supporting structure 2; and (2) the assembling end 326 of the underarm structure 3 inserts into the recess portion 24.

Figure 8:
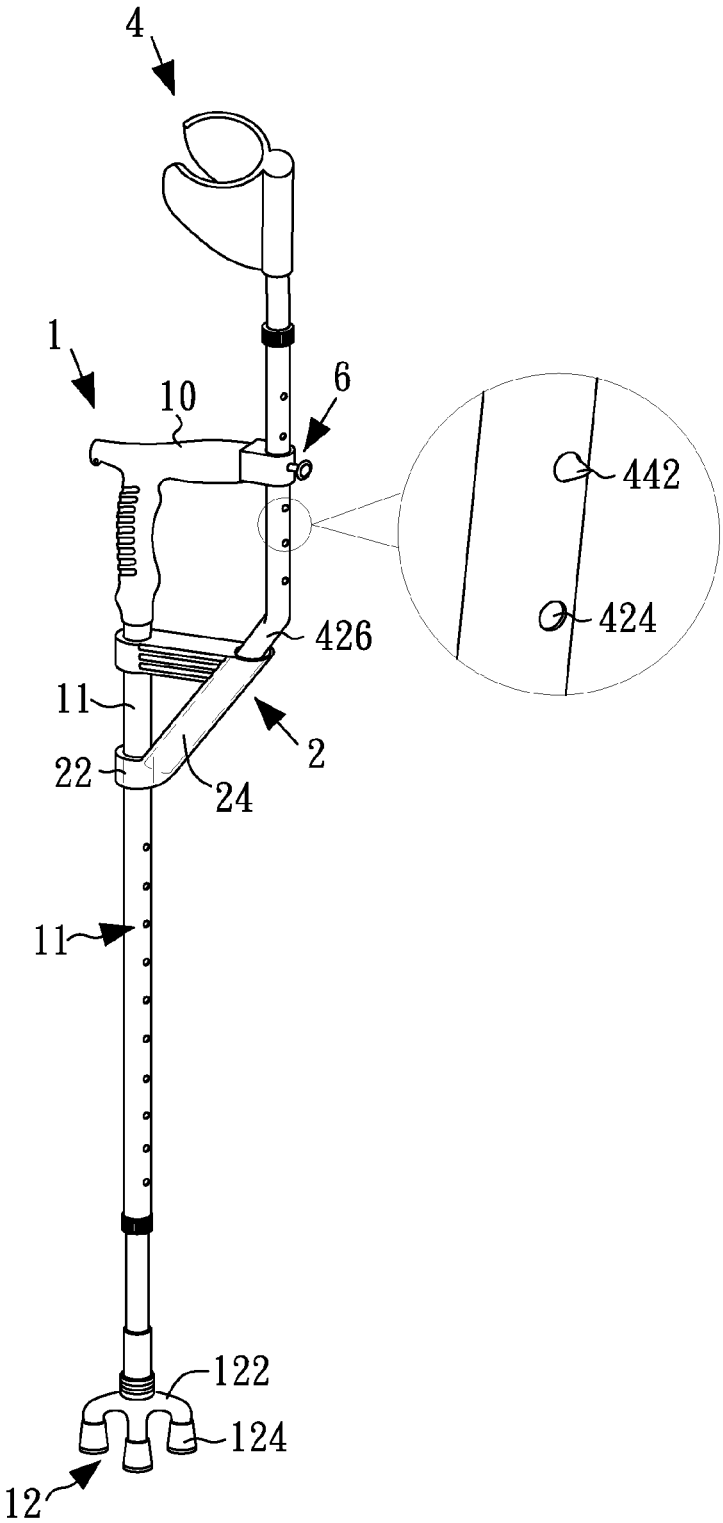
FIG. 8 is a front view showing that the crutch structure and the forearm structure is combined as a forearm crutch according to the preferred embodiment of the present invention.

FIG. 8 shows that the combination of the crutch structure 1 and the forearm structure 4 via the supporting structure 2 can be used as a forearm crutch. In detail, the combination is done by: (1) the stick 11 of the crutch structure 1 passes through the through portion 22 of the supporting structure 2; and (2) the assembling end 426 of the forearm structure 4 inserts into the recess portion 24.

Figure 9:
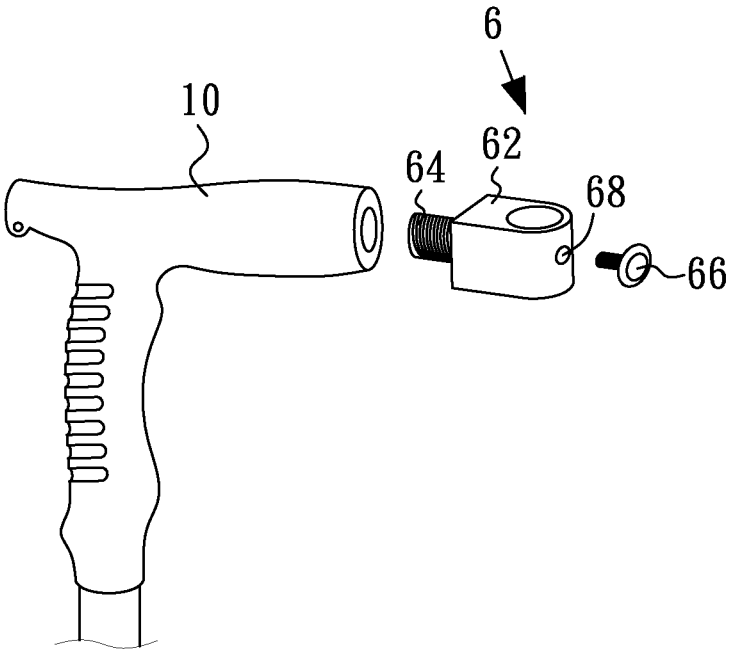
FIG. 9 is a partially enlarged view showing a fastening mechanism of the multi-function crutch according to the preferred embodiment of the present invention.

According to the embodiments of the present invention, the multi-function crutch may comprise one or more fastening mechanism for fixing the crutch structure 1 and the additional crutch structure and/or the supporting structure 2. FIG. 9 shows a fastening mechanism 6 according to the preferred embodiment of the present invention. As shown in FIGS. 7-9, the handle 10 of the crutch structure 1 can be fixed with one additional crutch structure, such as the underarm structure 3 or the forearm structure 4 by employing the fastening mechanism 6. In detail, the fastening mechanism 6 comprises a hollowed body 62 through which the additional crutch structure passes. In addition, the hollowed body 62 has a side with a coupling portion 64 coupling with the handle 10 of the crutch structure 1 by screwing, fitting, and/or other manners. Further, the hollowed body 62 has another opposite side with a hole 68 for matching a bolt 66 or a screw 66. Both the bolt 66 and the hole 68 have thread matching with each other. Accordingly, when tightening the bolt 66, the additional crutch structure 3/4 cannot be slid along the stick 11; and when releasing the bolt 66, the additional crutch structure 3/4 can be slid along the stick 11. According to the embodiments of the present invention, it may use other fastening mechanism. In one embodiment, the supporting structure 2 fixes with the stick 11 of the crutch structure 1 via one or more screws.

Accordingly, the embodiments of the present invention provide multi-function crutches, which is quite convenient to people needing various function. People can merely buy the necessary one or more additional crutch structures. so as to save the cost.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features mechanism out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts mechanism forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A multi-function crutch, comprising:

a crutch structure having a handle, a stick, and a support;

a supporting structure having a through portion and a recess portion; and one or more additional crutch structures, wherein the crutch structure itself is capable of being used as a first type of crutch, and via the supporting structure, the crutch structure combines one of the one or more additional crutch structures so that the combination is used as a second type of crutch;

wherein the combination is achieved by: the stick of the crutch structure being passed through the through portion of the supporting structure, and an assembling end of the additional crutch structure being inserted into the recess portion of the supporting structure.

2. The multi-function crutch of claim 1, wherein the one or more additional crutch structure comprise an underarm structure.

3. The multi-function crutch of claim 1, wherein the one or more additional crutch structure comprise a forearm structure.

4. The multi-function crutch of claim 1, further comprising a fastening mechanism for fixing the crutch structure and the additional structure.

5. The multi-function crutch of claim 4, wherein the fastening mechanism comprises a bolt and a hollowed body through which the additional crutch structure passes, and wherein the hollowed body has a side with a coupling portion coupling with the handle and another opposite side with a hole matching the bolt.

6. The multi-function crutch of claim 1, wherein the support comprises a plurality of legs.

7. The multi-function crutch of claim 1, wherein the crutch structure has a length-adjusting mechanism.

8. The multi-function crutch of claim 1, wherein each of the one or more additional crutch structures has a length-adjusting mechanism.

9. A multi-function crutch, comprising:

a crutch structure having a handle, a stick, and a support;

a supporting structure having a through portion and a recess portion; and one or more additional crutch structures, wherein the crutch structure itself is capable of being used as a first type of crutch, and when the crutch structure combines one of the one or more additional crutch structures via the supporting structure, the combined configuration is used as a second type of crutch; and wherein the combination is achieved by: the stick of the crutch structure being passed through the through portion of the supporting structure, an assembling end of the additional crutch structure being inserted into the recess portion of the supporting structure, and the additional crutch structure being fixed with the handle of the crutch structure.

* * * * *